US007314371B2

(12) United States Patent
Hsu

(10) Patent No.: US 7,314,371 B2
(45) Date of Patent: Jan. 1, 2008

(54) IGNITER WITH A SAFETY SWITCH

(76) Inventor: Huang-Hsi Hsu, 8F., No. 14, Lane 252, Chungshan N. Rd., Sec. 6, Taipei (TW)

( * ) Notice: Subject to any disclaimer, the term of this patent is extended or adjusted under 35 U.S.C. 154(b) by 42 days.

(21) Appl. No.: 11/184,909

(22) Filed: Jul. 20, 2005

(65) Prior Publication Data

US 2007/0020569 A1 Jan. 25, 2007

(51) Int. Cl.
*F23D 11/36* (2006.01)

(52) U.S. Cl. ..... 431/153; 431/255

(58) Field of Classification Search ..... 431/183, 431/255, 153

See application file for complete search history.

(56) References Cited

U.S. PATENT DOCUMENTS 4,502,465 A * 3/1985 Yoshinaga et al. ..... 126/409
4,538,983 A * 9/1985 Zeller et al. ..... 431/255
4,569,654 A * 2/1986 Borghesi ..... 431/255
4,778,380 A * 10/1988 Nitta ..... 431/255
5,460,521 A * 10/1995 Tsai ..... 431/255
5,550,420 A * 8/1996 Hsu ..... 310/339
5,865,614 A * 2/1999 Hsu ..... 431/255
5,931,656 A * 8/1999 Kanno ..... 431/153
6,213,759 B1 * 4/2001 Sung ..... 431/153
6,244,858 B1 * 6/2001 Wang ..... 431/153
6,468,070 B1 * 10/2002 Jon ..... 431/153
2001/0023054 A1 * 9/2001 Sung ..... 431/153
2002/0061488 A1 * 5/2002 Sung ..... 431/143
2003/0143505 A1 * 7/2003 Puig-Gros ..... 431/153
2003/0203331 A1 * 10/2003 Hsu ..... 431/153

* cited by examiner

*Primary Examiner*—Carl D. Price
(74) *Attorney, Agent, or Firm*—Bacon & Thomas, PLLC

(57) ABSTRACT

An igniter with a safety switch includes an ignition section, a pressing section, a gas storage tank, a gas outlet valve, and an electric arc generator, and a safety switch, wherein the safety switch is connected to the pressing section and latched with the pressing section, such that the pressing section cannot be pressed if the safety switch is not pushed. If the safety switch is pushed, the gas outlet valve will be opened to allow gas to flow to the ignition section. If the pressing section is pressed at this time, an electric arc will be produced to light up the gas. Therefore, it is necessary to simultaneously push the safety switch and press the pressing section to complete an ignition, and thus can greatly reduce the risk of having an accident.

2 Claims, 3 Drawing Sheets

IGNITER WITH A SAFETY SWITCH

FIELD OF THE INVENTION

The present invention generally relates to igniters, and more particularly to an igniter with a safety switch.

BACKGROUND OF THE INVENTION

Referring to FIG. 1 for a prior art ignition gun with a safety switch, the ignition gun comprises a casing 1, and the casing 1 includes a holding section 10 disposed at an end of the casing 1, and an ignition pipe 11 sheathed into another end of the casing 1, a press button 12 installed between the holding section 10 and the ignition pipe 11, a safety switch 13 installed at the holding section 10 proximate to a side of the press button 12, a blocking member 130 disposed in the holding section 10 of the safety switch 13 and extended towards the press button 12, and the blocking member 130 precisely presses against a latch member 120 of the press button 12 in the casing 1, so that the press button 12 can no longer be pressed. If the safety switch 13 is pushed, the blocking member 130 will be separated from the latch member 120, so that the press button 12 can be pressed. As a result, the latch member 120 and the blocking member 130 are used to provide a safety protection of the ignition gun.

Referring to FIG. 1 again, the casing 1 further comprises a gas storage tank 14, a gas outlet valve 15, a pipe body 16, a nozzle 17 and a driving member 18; wherein the gas storage tank 14 is installed at an appropriate position of the holding section 10 for storing gas fuel; the gas outlet valve 15 is installed on the gas storage tank 14 at a position proximate to the press button 12; an end of the pipe body 16 is connected to the gas outlet valve 15 and the other end is connected to the nozzle 17 disposed on another end of the casing 1; the driving member 18 is installed between the press button 12 and the gas storage tank 14; one end of the driving member 18 is coupled to the gas outlet valve 15 and the other end presses against the press button 12; and a protruded member 180 disposed between both ends of the driving member 18 presses against the gas storage tank 14. If the press button 12 is pressed, the press button 12 drives another end of the driving member 18 to move towards the gas storage tank 14 and an end of the driving member 18 to move away from the gas storage tank 14, such that the gas outlet valve 15 is lifted to allow the gas in the gas storage tank 14 to flow through the gas outlet valve 15 into the pipe body 16 and is ejected to the outside from the nozzle 17.

Referring to FIG. 1 again, the casing 1 further comprises an electric arc generator 19 installed between the press button 12 and the ignition pipe 11, and the electric arc generator 19 includes a starter end 190, an electric wire 192 and another electric wire 194, wherein the starter end 190 precisely presses against a trigger section 122 disposed on the press button 12, and the electric wire 192 can be extended to the other end in the casing 1 and connected to the nozzle 17. The other electric wire 194 passes through an opening 110 disposed on another end proximate to the casing 1 to connect the ignition pipe 11, such that the other electric wire 194 forms an arc generate circuit with a discharge pin which is installed on the ignition pipe 11 at a position proximate to the nozzle 17. If the press button 12 is pressed, not only the gas fuel can be ejected from the nozzle 17, but the starter end 190 also can be triggered by the trigger section 122, so that the electric arc generator 19 produces a high-voltage current to the nozzle 17 through the electric wire 192, and a discharge pin produces an electric arc to light up the gas flowing out from the nozzle 17, so as to complete an ignition.

After the ignition gun is used, the press button 12 cannot be pressed again since the safety switch 13 has not returned to its original position yet, and the ignition gun may trigger the press button 12 to light up the gas again. Further, the latch member 120 is connected with a very small area of the blocking member 130. If a user forgets that the ignition gun is set in a non-pressible status, or a child does not know that the ignition gun comes with a safety switch 13, or even a user wrongly believes that the press button 12 gets stuck or has a unsmooth slide, then an excessively large force may be applied to press the ignition gun and crack or break the blocking member 130 or the latch member 120. As a result, the press button 12 cannot be latched or pressed. Since the gas will be discharged to produce an electric arc and light up the gas once the press button 12 is pressed, therefore the ignition gun totally loses its safety function, and it cannot effectively prevent children from lighting up the ignition gun while playing with it or it may even cause regrettable accidents. It is definitely a good news for users to have a safety ignition gun to overcome such shortcomings.

SUMMARY OF THE INVENTION

In view of the shortcomings of the prior arts, the inventor of the present invention conducted extensive researches and experiments and finally developed an igniter with a safety switch in accordance with the present invention.

Therefore, it is a primary objective of the invention to provide an igniter with a safety switch comprising: a casing, and the casing includes an ignition section disposed at an end of the casing, a gas storage tank disposed on another end of the casing, and one end of the gas storage tank is proximate to the other end of the casing, and the other end of the gas storage tank is connected to a gas outlet valve, such that an electric arc generator capable of producing an electric arc is disposed between the ignition section and the gas outlet valve. The casing further comprises a pressing section disposed on one side, and one side of the pressing section is exposed from the casing, and the other side is coupled with the electric arc generator. A safety switch is movably coupled proximate to the pressing section, and an end of the safety switch is exposed from the casing, and the other end can latch the pressing section, so that the pressing section cannot be pressed. In the meantime, the pressing section is connected to the gas outlet valve, such that if the safety switch is pushed, the gas outlet valve will be opened to allow gas to flow out to the ignition section, and the pressing section will no longer be latched. If the pressing section is pressed, the electric arc will be produced to light up the gas. Therefore, regardless of the safety switch being latched by the pressing section, it is necessary to simultaneously push the safety switch and press the pressing section to complete the ignition, and such arrangement can greatly reduce the risk of having accidents.

The above and other objects, features and advantages of the present invention will become apparent from the following detailed description taken with the accompanying drawings.

DETAILED DESCRIPTION OF THE PREFERRED EMBODIMENTS

Figure 1:
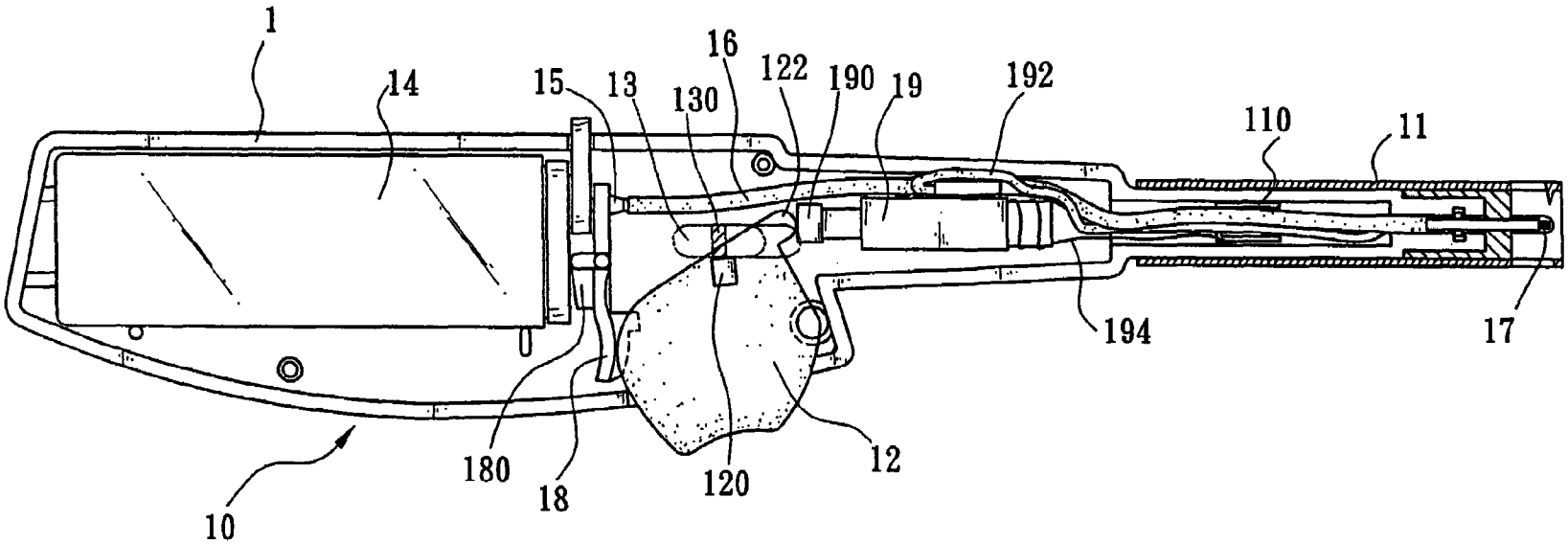
FIG. 1 (Prior Art)
FIG. 1 is a schematic view of a prior art ignition gun.
Figure 2:
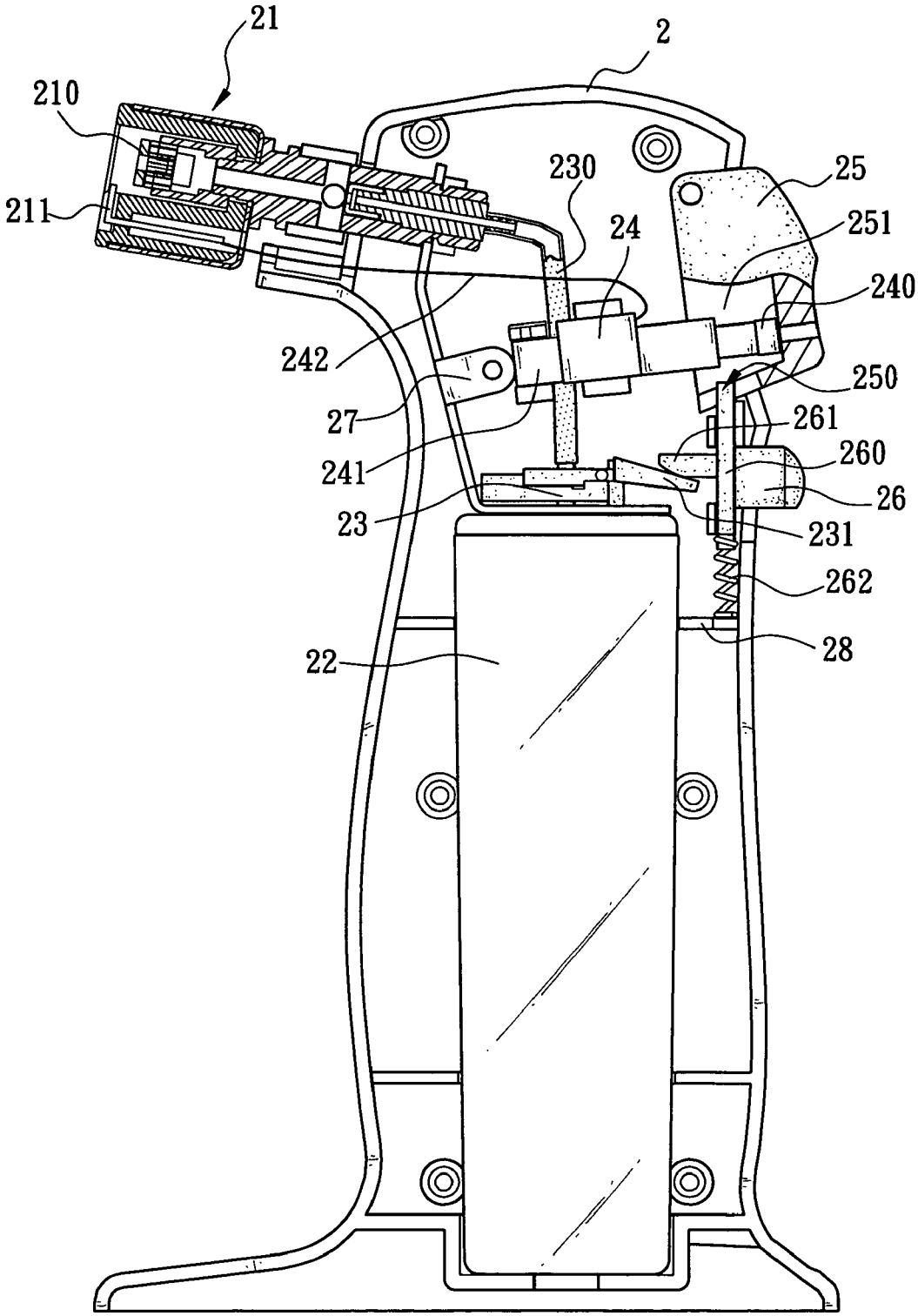
FIG. 2 is a schematic view of the internal structure of an igniter according to a preferred embodiment of the present invention.

Referring to FIG. 2 for the igniter with a safety switch in accordance with the present invention, the igniter comprises a casing 2, and the casing 2 includes an ignition section 21, a gas storage tank 22, a gas outlet valve 23 and an electric arc generator 24; wherein the ignition section 21 is disposed at an end of the casing 2; the gas storage tank 22 is installed at another end of the casing 2 for storing a gas fuel; the gas outlet valve 23 is installed at an end of the gas storage tank 22 facing the casing 2; the electric arc generator 24 is installed between the ignition section 21 and the gas outlet valve 23 for producing an electric arc in the ignition section 21. The casing 2 further comprises a pressing section 25 and a safety switch 26 on one side, wherein one side of the pressing section 25 is exposed from the casing 2 for users to press, and the other end of the pressing section 25 is connected with the electric arc generator 24; the safety switch 26 is movably coupled to a position proximate to the pressing section 25, and an end of the safety switch 26 is exposed from the casing 2, and the other end latches the pressing section 25, so that the pressing section 25 cannot be pressed. The pressing section is connected with the gas outlet valve 23, such that the safety switch 26 can be pressed to release the pressing section 25, while the safety switch 26 opens the gas outlet valve 23 to allow the gas flowing into the ignition section 21. Now, the pressing section 25 is pressed again to trigger the electric arc generator 24 to produce an electric arc, so as to light up the gas and complete the ignition. Therefore, regardless of the pressing section 25 being latched by the safety switch 26, a user can simultaneously push the safety switch 26 and press the pressing section 25 to complete the ignition, and thus the invention can greatly reduce accidents.

Referring to FIG. 2 for the preferred embodiment of the invention again, the electric arc generator 24 comprises a starter end 240, a ground end 241 and a conductive wire 242, wherein the starter end 240 is coupled with the pressing section 25 for user to press the pressing section 25; the ground end 241 is connected with a fixed stand 27 in a casing 2, and the fixed stand 27 is connected with the ignition section 21, such that the ground end 241 is electrically connected with the ignition section 21; the conductive wire 242 is extended into the ignition section 21 to form an electric arc generate circuit, such that when the pressing section 25 is pressed, the starter end 240 triggers the electric arc generator 24 to produce a high-voltage current that is sent to the ignition section 21 through the conductive wire 242, and an electric arc is produced in the ignition section 21.

Referring to FIG. 2 for the preferred embodiment again, the ignition section 21 includes a nozzle 210 and a discharge pin 211, wherein the nozzle 210 is installed at the middle of the ignition section 21 for ejecting the gas flowing into ignition section 21 out from the ignition section 21; and the discharge pin 211 is installed at an appropriate position proximate to the nozzle 210, and the discharge pin 211 is connected with the conductive wire 242, so that when the gas flowing out of the nozzle 210, the discharge pin 211 receives the high-voltage current and produces an electric arc on the discharge pin 211 to light up the gas flowing out from the nozzle 210 and completes the ignition.

Referring to FIG. 2 for the preferred embodiment again, the gas outlet valve 23 comprises a pipe body 230 and a driving plate 231; wherein an end of the pipe body 230 is connected to the gas outlet valve 23 and the other end is connected to the nozzle 210; the driving plate 231 is pivotally coupled inside the casing 2, and an end of the driving plate 231 is latched onto the gas outlet valve 23, and the other end is connected to the safety switch 26, such that when the safety switch 26 is pushed to drive the other end of the driving plate 231, one end of the driving plate 231 can open the gas outlet valve 23, and the gas flows through the pipe body 230 into the nozzle 210.

Referring to FIG. 2 for the preferred embodiment again, the pressing section 25 is pivotally coupled in the casing 2, and one side of the pressing section 25 is exposed from the casing 2, and the other side includes an accommodating space 250 and another accommodating space 251; wherein the accommodating space 250 is facing the safety switch 26; and if the safety switch 26 is not pushed, a portion containing the safety switch 26 latches the pressing section 25 and prevents the pressing section 25 from being pressed. The other accommodating space 251 is facing the electric arc generator 24 for accommodating the starter end 240, so that the starter end 240 precisely presses against the bottom of the accommodating space 250.

Referring to FIG. 2 for the preferred embodiment again, an end of the safety switch 26 is extended outside the casing 2 for users to press, and the other end comprises a panel member 260, a driving end 261 and a resilient device 262; wherein an end of the panel member 260 can be accommodated in the accommodating space 250 if the safety switch 26 is not pushed, and the pressing section 25 cannot be pressed. The resilient device 262 is installed between another end of the panel member 260 and a rib 28 inside the casing 2, so that an end of the panel member 260 is pushed further into the accommodating space 250, and the pressing section 25 cannot be pressed. The driving end 261 is connected to another end of the driving plate 231, such that when the safety switch 26 is pushed, an end of the panel member 260 can leave the accommodating space 250, and the driving end 261 presses against another end of the driving plate 231 so as to discharge the gas out of the gas outlet valve 23.

Figure 3:
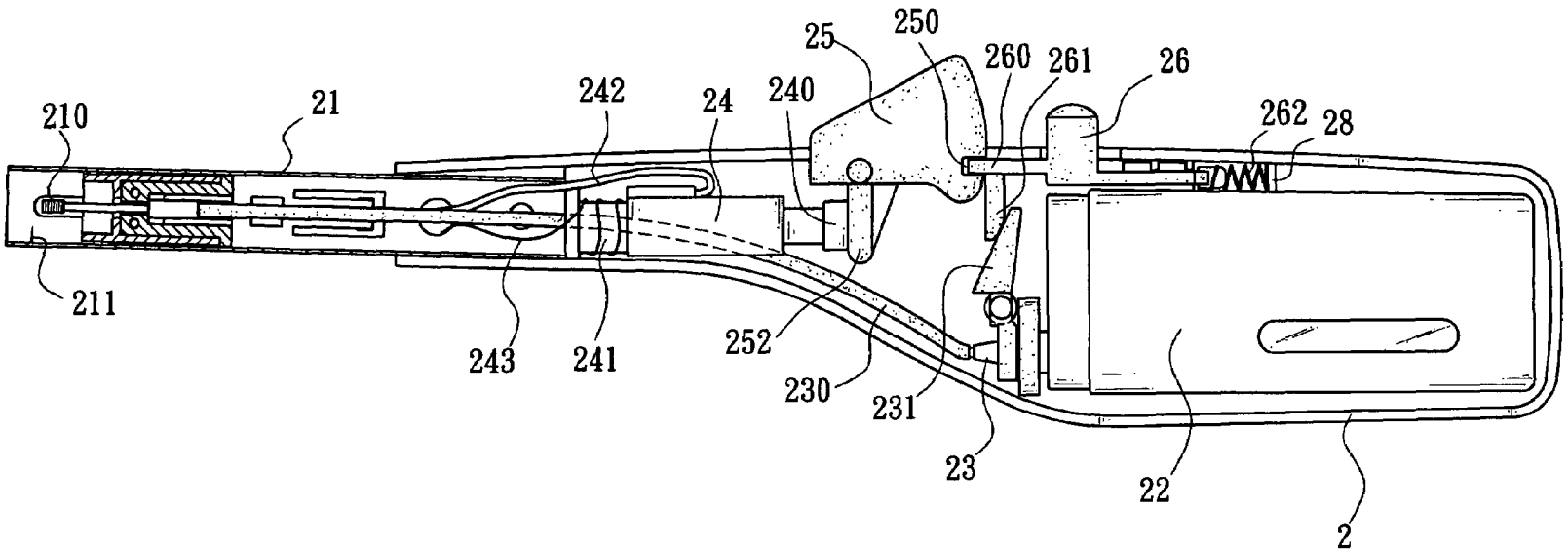
FIG. 3 is a schematic view of the internal structure of an igniter according to another preferred embodiment of the present invention.

Referring to FIG. 3 for another preferred embodiment of the present invention, the electric arc generator 24 comprises a starter end 240, a conductive wire 242 and another conductive wire 243; wherein the starter end 240 precisely presses against the pressing section 25, and if the pressing section 25 is pressed to trigger the electric arc generator 24, the conductive wire 242 will be extended into the ignition section 21, and the other conductive wire 243 will be coupled with the ignition section 21 to electrically connect the conductive wire 242 with the ignition section 21 to produce an electric arc generate circuit. If the pressing section 25 is pressed, the starter end 240 will trigger the electric arc generator 24 to produce a high-voltage current to be passed into the ignition section 21 through the conductive wire 242 and produce the electric arc in the ignition section 21.

Referring to FIG. 3 for the preferred embodiment again, the ignition section 21 comprises a nozzle 210 and a discharge pin 211; wherein the nozzle 210 is installed at the middle of the ignition section 21 for discharging the gas flowing into the ignition section 21 out of the ignition section 21; the discharge pin 211 is installed at a position proximate to the nozzle 210, and the discharge pin 211 is connected with the conductive wire, such that when the gas flowing out of the nozzle 210, the discharge pin 211 receives a high-voltage current to produce an electric arc on the discharge pin 211, and the gas flowing out of the nozzle 210 is lit up to complete the ignition.

Referring to FIG. 3 for the preferred embodiment again, the gas outlet valve 23 comprises a pipe body 230 and a driving plate 231, wherein an end of the pipe body 230 is connected to the gas outlet valve 23, and the other end is connected to the nozzle 210; the driving plate 231 is pivotally coupled in the casing 2, and an end of the driving plate 231 is latched onto the gas outlet valve 23, and the other end is connected to the safety switch 26, such that when the safety switch 26 is pushed to drive another end of the driving plate 231, and one end of the driving plate 231 opens the gas outlet valve 23 and allows the gas flowing into the nozzle 210 through the pipe body 230.

Referring to FIG. 3 for the preferred embodiment again, the pressing section 25 is pivotally coupled into the casing 2, and an end of the pressing section 25 is exposed from one side of the casing 2 for users to press, and another side includes an accommodating space 250 and a triggering end 252; wherein the accommodating space 250 is facing the safety switch. 26, and if the safety switch 26 is not pushed, the accommodating space 250 can accommodate a portion of the safety switch 26, so that the pressing section 25 can be latched and cannot be pressed. The triggering end 252 is facing the starter end 240, and if the pressing section 25 is not pressed, the pressing section 25 precisely presses against the starter end 240. If the pressing section 25 is pressed, the triggering end 252 pushes the starter end 240 to drive the electric arc generator 24 to produce a high-voltage current.

Referring to FIG. 3 for the preferred embodiment again, an end of the safety switch 26 is extended out of the casing 2, and another end includes a panel member 260 and a driving end 261; wherein an end of the panel member 260 can be accommodated in the accommodating space 250 when the safety switch 26 is not pushed, such that the pressing section 25 cannot be pressed. The other end of the panel member 260 is connected with a resilient device 262, and an end of the resilient device 262 is disposed on a rib 28 inside the casing 2, and the other end presses the other end of the panel member 260, so that an end of the panel member 260 is pushed into the accommodating space 250, so that the pressing section 25 cannot be pressed. The driving end 261 is connected to another end of the driving plate 231, so that when the safety switch 26 is pushed, an end of the panel member 260 leaves the accommodating space 250, and the driving end 261 presses another end of the driving plate 231 to eject the gas from the gas outlet valve 23.

In summation of the description above, the structure and the shape of the igniter according to the present invention have the following objectives and functions:

1. An end of the panel member 260 disposed on the safety switch 26 in accordance with the invention is extended into the accommodating space 250 to increase the contact area between the safety switch 26 and the pressing section 25, so that the pressing section 25 cannot be pressed easily, and the safety switch 26 will not be damaged easily when an excessively large force is applied to the pressing section 25.

2. The panel member 260 disposed on the safety switch 26 is coupled with the resilient device 262, so that the safety switch 26 can be pushed further to the pressing section 25, and thus when the use of the igniter ends, the safety switch 26 can be resumed automatically to its original position and latched by the pressing section 25 and cannot be pressed. In other words, an end of the panel member 260 is extended to a position in the accommodating space 250 to prevent the safety switch from not returning to its original position as it does in a prior art ignition gun, so as to avoid the ignition gun from being pressed to light up the gas by accident.

3. In the present invention, the safety switch 26 is used to open the gas outlet valve 23 and allows the discharge of the gas fuel, and the pressing section 25 is used to trigger the electric arc generator 24 to produce the electric arc. Even if a user applies an excessively large force onto an end of the panel member 260 disposed on the safety switch 26, the pressing section 25 will not be damaged, and the pressing section 25 can no longer be latched by the safety switch. Since the pressing section 25 can only trigger the electric arc generator 24 and cannot open the gas outlet valve 23, therefore a user has to push the safety switch 26 for an ignition. As a result, the igniter can always be latched by the pressing section 25, and will not lose its safety function, and thus can protect the user's safety.

While the invention herein disclosed has been described by means of specific embodiments, numerous modifications and variations could be made thereto by those skilled in the art without departing from the scope and spirit of the invention set forth in the claims.

What is claimed is:

1. An igniter with a safety switch, including a casing, and said casing comprising:

an ignition section, disposed at an end of said casing;

a gas storage tank, disposed at another end proximate to said casing for storing a gas fuel;

a gas outlet valve, disposed at an end of said gas storage tank facing said casing;

an electric arc generator, disposed between said ignition section and said outlet valve;

a pressing section, disposed at one side of said casing, and one side of said pressing section being exposed from said casing, and another side of said pressing section being coupled to said electric arc generator; and a safety switch coupled to said gas outlet valve and movably disposed on one side of said casing and at a position proximate to said pressing section, and a first end of said safety switch being exposed from said casing, and a second end of said safety switch selectively latching said pressing section, so that said pressing section cannot be pressed while said safety switch is in an unpressed position, and wherein pressing said safety switch opens said gas outlet valve and allows the pressing section to be pressed to trigger the electric arc generator;

wherein said electric arc generator comprises:

a starter end, coupled with said pressing section;

a conductive wire, extended into said ignition section, and when said starter end is triggered, said electric arc generator produces a high-voltage current to be sent to said ignition section through said conductive wire and produces an electric arc inside said ignition section; and a ground end, coupled with a fixed stand inside said casing, and said fixed stand is coupled with said ignition section, such that said ground end is electrically coupled with said ignition section to form an electric arc generate circuit;

wherein said ignition section comprises:

a nozzle, disposed at the middle of said ignition section; and a discharge pin, disposed proximate to said nozzle and coupled with said conductive wire, and when said gas fuel flows into said ignition section and said discharge pin receives a high-voltage current, said electric arc produced on said discharge pin lights up said gas fuel flowing out from said nozzle;

wherein said gas outlet valve comprises:

a pipe body, having an end coupled to said gas outlet valve, and the other end being coupled to said nozzle; and a driving plate, pivotally coupled with said casing, and a first end of said driving plate being latched to said gas outlet valve, and a second end of said driving plate being coupled with said safety switch, and said safety switch being pushed to drive the second end of said driving plate, so as to open said gas outlet valve;

wherein the pressing section further comprises:

a first accommodating space, facing said safety switch and accommodating a portion of said safety switch, when said safety switch is in an unpressed position; and a second accommodating space, facing said electric arc generator and being capable of accommodating said starter end, and said starter end precisely presses against a bottom of said second accommodating space;

wherein the first end of said safety switch has an end extended outside said casing, and the second end of said safety switch end comprises:

a panel member, having a first end accommodated in said first accommodating space when said safety switch is in an unpressed position;

a resilient device, disposed between a second end of said panel member and a rib disposed in said casing, such that the resilience of said resilient device pushes the second end of said panel member, and the first end of said panel member is biased towards said first accommodating space; and a driving end, coupled to said driving plate, and when said safety switch is pressed, the first end of said panel member leaves said first accommodating space while said driving end presses said driving plate.

2. An igniter with a safety switch, including a casing, and said casing comprising:

an ignition section, disposed at an end of said casing;

a gas storage tank, disposed at another end proximate to said casing for storing a gas fuel;

a gas outlet valve, disposed at an end of said gas storage tank facing said casing;

an electric arc generator, disposed between said ignition section and said outlet valve;

a pressing section, disposed at one side of said casing, and one side of said pressing section being exposed from said casing, and another side of said pressing section being coupled to said electric arc generator; and a safety switch coupled to said gas outlet valve and movably disposed on one side of said casing and at a position proximate to said pressing section, and a first end of said safety switch being exposed from said casing, and a second end of said safety switch selectively latching said pressing section, so that said pressing section cannot be pressed while said safety switch is in an unpressed position, and wherein pressing said safety switch opens said gas outlet valve and allows the pressing section to be pressed to trigger the electric arc generator;

wherein said electric arc generator comprises:

a starter end, precisely pressing against said pressing section;

a conductive wire, extended into said ignition section, and when said starter end is triggered, said electric arc generator produces a high-voltage current to be sent to said ignition section through said conductive wire, and said ignition section produces said electric arc therein; and another conductive wire, coupled with said ignition section to form an electric arc generate circuit;

wherein said ignition section comprises:

a nozzle, installed at the middle of said ignition section; and a discharge pin, installed at a position proximate to said nozzle and coupled with said conductive wire, and when said gas fuel flows into said ignition section and said discharge pin receives said high-voltage current, said electric arc produced on said discharge pin lights up said gas fuel flowing out from said nozzle;

wherein said gas outlet valve comprises:

a pipe body, having an end coupled to said gas outlet valve and another end coupled to said nozzle; and a driving plate, pivotally coupled inside said casing and having a first end of said driving plate latched to said gas outlet valve, and a second end coupled to said safety switch, and said safety switch being pressed to drive the second end of said driving plate so as to open said gas outlet valve;

wherein said pressing section is pivotally coupled inside said casing, and a first side of said pressing section is exposed from said casing for users to press, and a second side comprises:

a first accommodating space, facing said safety switch, and precisely accommodating a portion of said safety switch when said safety switch is not pressed; and a triggering end, facing said starter end and precisely pressing on said starter end when said pressing section is not pressed;

wherein the first end of said safety switch has an end extended outside said casing, and the second end of said safety switch comprises:

a panel member, having a first end of said panel member accommodated in said accommodating space when said safety switch is not pressed;

a resilient device, installed between a second end of said panel member and a rib disposed in said casing, such that the resilience of said resilient device pushes the second end of said panel member, and the first end of said panel member is biased towards said first accommodating space; and a driving end, coupled to said driving plate, and when said safety switch is pressed, the first end of said panel member leaves said first accommodating space, and said driving end presses said driving plate.

* * * * *